US008356611B2

(12) United States Patent
O'Hara

(10) Patent No.: US 8,356,611 B2
(45) Date of Patent: Jan. 22, 2013

(54) HEALTHY SUN-LIKE RAYS UMBRELLA

(76) Inventor: Blanche O'Hara, Newtown, PA (US)

( * ) Notice: Subject to any disclaimer, the term of this patent is extended or adjusted under 35 U.S.C. 154(b) by 147 days.

(21) Appl. No.: 13/070,471

(22) Filed: Mar. 23, 2011

(65) Prior Publication Data

US 2011/0232703 A1 Sep. 29, 2011

Related U.S. Application Data

(60) Provisional application No. 61/316,639, filed on Mar. 23, 2010.

(51) Int. Cl.
*A45B 3/02* (2006.01)

(52) U.S. Cl. ..... 135/16; 135/98; 135/91; 135/910; 362/102

(58) Field of Classification Search ..... 135/98, 135/91, 16, 910; 362/102
See application file for complete search history.

(56) References Cited

U.S. PATENT DOCUMENTS 4,174,532 A * 11/1979 Kelley ..... 362/102
5,126,922 A 6/1992 Andreasen
5,463,536 A 10/1995 Chou et al.
5,584,564 A * 12/1996 Phyle ..... 362/102
6,152,491 A 11/2000 Queentry
6,341,873 B1 1/2002 Yang
6,499,856 B2 12/2002 Lee
6,752,509 B1 6/2004 Lin et al.
7,003,217 B2 * 2/2006 Bachinski et al. ..... 392/411
7,063,434 B2 6/2006 Wu
7,404,652 B2 * 7/2008 Ng et al. ..... 362/231
7,815,331 B2 10/2010 Chronopoulos
2003/0216795 A1 * 11/2003 Harth et al. ..... 607/88
2004/0100799 A1 * 5/2004 Chu et al. ..... 362/352
2004/0105252 A1 6/2004 Lin et al.
2005/0172986 A1 8/2005 Lu
2007/0047222 A1 3/2007 Chang
2007/0189002 A1 8/2007 Thode
2007/0209694 A1 * 9/2007 Gooch et al. ..... 135/91
2007/0242450 A1 * 10/2007 Blatecky ..... 362/102
2008/0062675 A1 * 3/2008 Tung ..... 362/102
2008/0087310 A1 4/2008 Dahinden
2008/0142768 A1 * 6/2008 Thorpe et al. ..... 254/423
2008/0180937 A1 * 7/2008 Pengelly ..... 362/85
2010/0249610 A1 * 9/2010 Boe ..... 600/476

* cited by examiner

*Primary Examiner* — Winnie Yip
(74) *Attorney, Agent, or Firm* — Thien Tran, Esq; Access Patent Group, LLC

(57) ABSTRACT

A healthy sun-like rays umbrella includes at least one UV blue light emission device and a means for mounting the at least one UV blue light emission device onto at least one stretcher of the umbrella. At least one person using the umbrella will receive the benefits of the at least one UV blue light emission device for a seasonal affective disorder and a more versatile way to increase vitamin D levels.

11 Claims, 4 Drawing Sheets

HEALTHY SUN-LIKE RAYS UMBRELLA

CROSS-REFERENCE TO RELATED APPLICATION

This application claims the benefit of Provisional Patent Application No. 61/316,639, filed on Mar. 23, 2010, in the United States Patent & Trademark Office, the disclosure of which is incorporated herein by reference.

BACKGROUND OF THE INVENTION

1. Field of the Invention

The present invention relates to an umbrella, and more particularly, a healthy sun-like rays umbrella.

The healthy sun-like rays umbrella is a new and improved umbrella that has an integrated UV blue therapy light. The present invention affords a user the ability to receive the benefits of UV blue lights while on the go. Additionally, the healthy sun-like rays umbrella can be used in the conventional manner to shield an individual from rain or excess sun. The present invention can be available to consumers in various forms, including those used while walking, playing golf, relaxing at the beach, or sitting on the back patio. Any individual currently undergoing light therapy for a seasonal affective disorder, or those looking for a more versatile way to increase vitamin D levels, will benefit from using the healthy sun-like rays umbrella.

2. Description of the Prior Art

It is a common fact that several illnesses are linked to low levels of vitamin D. Sunlight naturally stimulates the body's production of this vitamin, which is why so many individuals feel the effects of deficiency-related illnesses during the wintertime. Many doctors and therapists recommend that patients try a UV blue light box to simulate the sun's rays and increase the production of vitamin D. Traditional light boxes are not portable and require the user to remain stationary while undergoing treatment. This is not convenient for most consumers. A more efficient option is needed.

Numerous innovations for illuminated umbrellas have been provided in the prior art that will be described. Even though these innovations may be suitable for the specific individual purposes to which they address, however, they differ from the present invention.

A FIRST EXAMPLE, U.S. Pat. No. 5,126,922, Issued on Jun. 30, 1992, to Andreasen teaches an illuminated umbrella or parasol, in which there are two coaxial light conductors (not shown) within the umbrella stick. The inner light conductor supplies light to the central region of the cover, to a number of further light conductors in the ribs terminated by light-spreading rib caps, and to a light spreading top spike, while the outer light conductor supplies light to the peripheral region of the cover. Emphasis on the illumination may be switched between the two coaxial light conductors by means of optical means (not shown) in the handle, controlled by a manually slideable button, the handle also containing the requisite batteries, a light bulb and a lens and/or a reflector (not shown), the switching e.g. being achieved by altering the position of the bulb.

A SECOND EXAMPLE, U.S. Pat. No. 5,463,536, Issued on Oct. 31, 1995, to Chou et al. teaches an umbrella having a light source mounted inside the umbrella handle and controlled by a slide switch to give off light through a refractor around the umbrella shaft, wherein the umbrella shaft is a transparent, solid, polygonal rod having a refracting area for refracting the light of the light source toward the ribs and umbrella cover of the umbrella.

A THIRD EXAMPLE, U.S. Pat. No. 5,865,202, Issued on Feb. 2, 1999, to Murphy teaches a luminous umbrella that uses a high proportion of the light generated by mounting the light bulb high on the shaft such that most of the light from the light bulb is projected on the underside of the umbrella canopy. The underside has a high luminous reflectance and is curved, consequently focusing the light from the light bulb down to illuminate a space immediately around the user. This luminous space widens towards the bottom, thereby providing the widest illumination at the ground where it is most needed. As a result of the light being efficiently focused, the required luminosity of the light bulb is reduced, enabling the umbrella to be powered using an incandescent light bulb and a few 1.5 volt batteries. Alternatively, if it is desired to provide extremely bright illumination, the conventional incandescent bulb may be replaced with a halogen bulb. The batteries still suffice to provide bright illumination by the halogen bulb.

A FOURTH EXAMPLE, U.S. Pat. No. 6,341,873, Issued on Jan. 29, 2002, to Yang teaches an umbrella with an illumination device. The illumination device has a top illumination assembly on the top end of the shaft, a tip illumination assembly on the free end of each rib and a control assembly to provide electricity to each illumination assembly. The top illumination assembly comprises a transparent connecting tube, a transparent tubular member, an internal wall integrally formed in the tubular member, an LED received in the tubular member and two electrical wires connected to the LED. The tip illumination assembly comprises a transparent tip, a conical hole defined in the tip, an LED and two branch electrical wires connected to the LED. The control assembly comprises a control unit in the shaft, an electrical connecting unit and two main electrical wires connected between the control unit and the electrical connecting unit. By such an arrangement, the illumination device can provide good illumination to increase the safety of using the umbrella.

A FIFTH EXAMPLE, U.S. Pat. No. 6,499,856, Issued on Dec. 31, 2002, to Lee teaches a beach umbrella with lamps includes mainly a plurality of spreaders and ribs respectively having a C-shaped insert groove opening downward, and a plurality of small lamps fitted in each C-shaped groove as if hidden in the spreaders and the ribs, and a switch fixed on a lower portion of the shank to turn on and off the small lamps so as to facilitate assembly and use of the beach umbrella with lamps. Then the lamps may be lit on and off to shine in the umbrella during nighttime to set forth gracious atmosphere.

A SIXTH EXAMPLE, U.S. Patent Office Publication No. 2004/0007259, Published on 01-15, 2004, to Manolis teaches a fashion umbrella comprising an umbrella shank, a ring around the shank, numerous umbrella ribs connected at the upper end of the shank and extend outwardly to tips, numerous spreaders connected to the ring and extend outwardly in radius configuration and connected to the umbrella ribs. A hollow umbrella handle attached at the lower end of the shank. A battery is housed into hollow handle. Electric wires are housed into the hollow shank and extend to the tips of the umbrella ribs. Numerous light bulbs are mounted on the tips of the ribs, the light bulbs are connected to the battery through the electric wires, an electric switch is provided to turn the light bulbs ON and OFF. A fiber optic system is mounted on the shank under the canopy of the umbrella; a single cable often contains many separate fiber optic filaments, allowing multiple light signals to be transmitted to tips of the ribs of the fashion umbrella.

A SEVENTH EXAMPLE, U.S. Patent Office Publication No. 2004/0100791, Published on May 27, 2004, to Bilotti et al. teaches a lighting system for use with a patio umbrella or gazebo. The lighting system has a battery housing or power source, and at least one wire branch, with each wire branch releasably attached to a corresponding one of the ribs of the patio umbrella, or to a portion of a gazebo. A plurality of LED devices are spaced apart along each wire branch, and an interconnecting wire couples the battery housing or the power source to the wire branches.

AN EIGHTH EXAMPLE, U.S. Patent Office Publication No. 2004/0105252, Published on Jun. 3, 2004, to Lin et al. teaches an illuminating umbrella grip includes a cassette LED illuminating unit detachably mounted in a holder formed on the umbrella grip, with the LED illuminating unit operatively depressed for a constant or flashing illumination; and upon withdrawal of the LED illuminating unit from the umbrella grip, it may be operated to produce illuminating warning signal for safety purpose, or it may be replaced with a fresh LED unit as fully powered.

A NINTH EXAMPLE, U.S. Pa. No. 6,752,509, Issued on Jun. 22, 2004, to Lin et al. teaches an illuminating umbrella grip includes a cassette LED illuminating unit detachably mounted in a holder formed on the umbrella grip, with the LED illuminating unit operatively depressed for a constant or flashing illumination; and upon withdrawal of the LED illuminating unit from the umbrella grip, it may be operated to produce illuminating warning signal for safety purpose, or it may be replaced with a fresh LED unit as fully powered.

A TENTH EXAMPLE, U.S. Patent Office Publication No. 2005/0172986, Published on Aug. 11, 2005, to Lu teaches an umbrella safety and alarm enhancement device, particularly an enhancement device installed on an umbrella to provide electro luminescence lighting or flashing at nighttime, forming a larger lighting rage, giving strong short-wave lighting alarm at night or in a rainy or foggy environment, the short waves of the electro luminescence is free from obstruction by rain or fog. The strong electro luminescence flashing light can be seen from a distance to prevent accidents and ensure pedestrians' safety.

AN ELEVENTH EXAMPLE, U.S. Patent Office Publication No. 2006/0039133, Published on Feb. 23, 2006, to Wu teaches a light source for an umbrella directly attached to its grip is set forth herein, a light source housing containing a light source, a battery unit, and a light source is engaged to the bottom of the umbrella grip. The battery power is directly supplied to the light source without using the electrical wiring. LED(s), or other high intensity lamps may be employed as the light source. The front portion of the light source housing is formed into a sloped surface serving as a refractor to conduct the light beam downwards and distribute it on the ground under the umbrella so as to assist the umbrella carrier walking at a dark, rainy night securely without the worry of a possible traffic accident.

A TWELFTH EXAMPLE, U.S. Patent Office Publication No. 2007/0047222, Published on Mar. 1, 2007, to Chang teaches an umbrella with light-emitting indicator. The umbrella with light-emitting indicator comprises an umbrella stand, a control circuit and a light-emitting device. The umbrella stand comprises a set of moveable ribs, a piece of umbrella cloth covered on the ribs and an insulative element with a receiving space formed on top end of the umbrella stand. The control circuit is securely installed in the receiving space of the insulative element, wherein the control circuit is connected to a battery and a switch. The light-emitting device is securely fixed onto surface of the umbrella cloth of the umbrella, wherein the light-emitting device is electrically connected to the control circuit.

A THIRTEENTH EXAMPLE, U.S. Patent Office Publication No. 2007/0189002, Published on Aug. 16, 2007, to Thode teaches an illuminated umbrella including a substantially translucent canopy supported by a plurality of ribs pivotally swingable towards and away from a shaft. Each of the ribs has attached intermediately of its length to one end of a spoke. The other spoke end is pivotally attached to a slidable sleeve on the umbrella shaft. At least one flexible isotropic electroluminescent string light source may be disposed along, and fastened to, at least one of the plurality of ribs. Alternatively, instead of being fastened to the ribs, the flexible isotropic electroluminescent string lights may be disposed in a pattern and attached to the canopy. A power supply disposed on the umbrella supplies power to the flexible isotropic electroluminescent light strings. Power may be supplied to the electroluminescent light strings without requiring the use of a connection socket or plug to the electroluminescent light strings.

A FOURTEENTH EXAMPLE, U.S. Patent Office Publication No. 2008/0087310, Published on Apr. 17, 2008, to Dahinden teaches a walking-stick umbrella comprises a grip element, a walking stick and a covering. The walking stick is made from an at least partially transparent or light-transmitting material. The grip element contains an energy storage element, a luminous element with which light can be irradiated into the walking stick, and an electronic device with which the luminous element can be automatically controlled.

A FIFTEENTH EXAMPLE, U.S. Patent Office Document No. 7,815,331, Issued on Oct. 19, 2010, to Chronopoulos teaches a lighting apparatus for attachment to an umbrella pole comprising, at least one arm having a first arm section, a second arm section, and a first hinged connection between a first end of the first arm section and a first end of the second arm section, an attachment means having a second hinged connection to a second end of the first arm section and securable to the umbrella pole, a connection means having a third hinged connection to a second end of the second arm section and slideably connected around the umbrella pole, and a lighting means on the at least one arm configured and disposed for illumination underneath the lighting apparatus wherein the hinge means, attachment means and connection means are configured and located to permit the at least one arm to move from an extended position away from the umbrella pole to a closed position substantially parallel to the umbrella pole.

A SIXTEENTH EXAMPLE, U.S. Patent Office Publication No. 2010/0328924, Published on Dec. 30, 2010, to Nissen teaches a lighted umbrella comprising a handle, a rod fixed on the handle, a structure for bearing a sheltering cover, the structure being fixed to the rod, a ferrule disposed on the rod for fixing the waterproof sheltering cover, the rod comprising at least a first and second hoses of transparent material which are separated by a hollow space, and the handle comprising an electric circuit connected to at least one LED to make the rod luminous.

A SEVENTEENTH EXAMPLE, U.S. Pat. No. 6,752,509, issued on Jun. 22, 2004, to Lin et al. teaches an illuminating umbrella grip includes a cassette LED illuminating unit detachably mounted in a holder formed on the umbrella grip, with the LED illuminating unit operatively depressed for a constant or flashing illumination; and upon withdrawal of the LED illuminating unit from the umbrella grip, it may be operated to produce illuminating warning signal for safety purpose, or it may be replaced with a fresh LED unit as fully powered.

A EIGHTEENTH EXAMPLE, U.S. Patent Office Publication No. 2005/0172986, Published on Aug. 11, 2005, to Lu teaches an umbrella safety and alarm enhancement device, particularly an enhancement device installed on an umbrella to provide electro luminescence lighting or flashing at nighttime, forming a larger lighting rage, giving strong short-wave lighting alarm at night or in a rainy or foggy environment, the short waves of the electro luminescence is free from obstruction by rain or fog. The strong electro luminescence flashing light can be seen from a distance to prevent accidents and ensure pedestrians' safety.

AN NINETEETH EXAMPLE, U.S. Patent Office Publication No. 2006/0039133, Published on Feb. 23, 2006, to Wu teaches a light source for an umbrella directly attached to its grip is set forth herein, a light source housing containing a light source, a battery unit, and a light source is engaged to the bottom of the umbrella grip. The battery power is directly supplied to the light source without using the electrical wiring. LED(s), or other high intensity lamps may be employed as the light source. The front portion of the light source housing is formed into a sloped surface serving as a refractor to conduct the light beam downwards and distribute it on the ground under the umbrella so as to assist the umbrella carrier walking at a dark, rainy night securely without the worry of a possible traffic accident.

A TWENTIETH EXAMPLE, U.S. Patent Office Publication No. 2006/0118150, Published on Jun. 8, 2006, to Mattuzzi teaches an umbrella fitted with a flashing yellow/amber light at the top of the shaft. When the umbrella is open and the user wishes to hail a taxicab, all they need to do is push a button on the shaft or at the light itself thereby activating the flashing yellow/amber light. This would result in the attraction of awaiting taxicabs. This yellow/amber light could also be retrofitted to existing umbrellas.

A TWENTY-FIRST EXAMPLE, U.S. Patent Office Publication No. 2007/0047222, Published on Mar. 1, 2007, to Chang teaches an umbrella with light-emitting indicator. The umbrella with light-emitting indicator comprises an umbrella stand, a control circuit and a light-emitting device. The umbrella stand comprises a set of moveable ribs, a piece of umbrella cloth covered on the ribs and an insulative element with a receiving space formed on top end of the umbrella stand. The control circuit is securely installed in the receiving space of the insulative element, wherein the control circuit is connected to a battery and a switch. The light-emitting device is securely fixed onto surface of the umbrella cloth of the umbrella, wherein the light-emitting device is electrically connected to the control circuit.

A TWENTY-SECOND EXAMPLE, U.S. Patent Office Publication No. 2007/0189002, Published on Aug. 16, 2007, to Thode teaches an illuminated umbrella including a substantially translucent canopy supported by a plurality of ribs pivotally swingable towards and away from a shaft. Each of the ribs has attached intermediately of its length to one end of a spoke. The other spoke end is pivotally attached to a slidable sleeve on the umbrella shaft. At least one flexible isotropic electroluminescent string light source may be disposed along, and fastened to, at least one of the plurality of ribs. Alternatively, instead of being fastened to the ribs, the flexible isotropic electroluminescent string lights may be disposed in a pattern and attached to the canopy. A power supply disposed on the umbrella supplies power to the flexible isotropic electroluminescent light strings. Power may be supplied to the electroluminescent light strings without requiring the use of a connection socket or plug to the electroluminescent light strings.

A TWENTY-THIRD EXAMPLE, U.S. Patent Office Publication No. 2008/0087310, Published on Apr. 17, 2008, to Dahinden teaches a walking-stick umbrella comprises a grip element, a walking stick and a covering. The walking stick is made from an at least partially transparent or light-transmitting material. The grip element contains an energy storage element, a luminous element with which light can be irradiated into the walking stick, and an electronic device with which the luminous element can be automatically controlled.

A TWENTY-FOURTH EXAMPLE, U.S. Patent Office Publication No. 2009/0260663, Published on Oct. 22, 2009, to Lewis teaches a safety umbrella for providing visibility for an individual crossing an intersection or walking at night or in dark rainy inclement weather includes a center pole having a cover at its upper end and an opposite hand gripping end that includes a housing and a loop and cap member detachably securable to the housing and the housing holding at least one battery interconnected to an on/off switch and a plurality of wires extending from within the housing through the center pole to the upper end for interconnection to a LED light enclosed within a transparent casing that projects above the cover and which is operable by the on/off switch so that the individual can be made more visible to other individuals and to automotive vehicles and thereby avoiding accidents and injuries to all parties.

A TWENTY-FIFTH EXAMPLE, U.S. Patent Office Document No. 7,815,331, Issued on Oct. 19, 2010, to Chronopoulos teaches a lighting apparatus for attachment to an umbrella pole comprising, at least one arm having a first arm section, a second arm section, and a first hinged connection between a first end of the first arm section and a first end of the second arm section, an attachment means having a second hinged connection to a second end of the first arm section and securable to the umbrella pole, a connection means having a third hinged connection to a second end of the second arm section and slideably connected around the umbrella pole, and a lighting means on the at least one arm configured and disposed for illumination underneath the lighting apparatus wherein the hinge means, attachment means and connection means are configured and located to permit the at least one arm to move from an extended position away from the umbrella pole to a closed position substantially parallel to the umbrella pole.

It is apparent now that numerous innovations for illuminated umbrellas have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a healthy sun-like rays umbrella that avoids the disadvantages of the prior art.

ANOTHER OBJECT of the present invention is to provide a healthy sun-like rays umbrella that is simple and inexpensive to manufacture.

STILL ANOTHER OBJECT of the present invention is to provide a healthy sun-like rays umbrella that is simple to use.

BRIEFLY STATED, STILL YET ANOTHER OBJECT of the present invention is to provide a healthy sun-like rays umbrella which comprises at least one UV blue light emission device and a means for mounting the at least one UV blue light emission device onto at least one stretcher of the umbrella. At least one person using the umbrella will receive the benefits of the at least one UV blue light emission device for a seasonal affective disorder and a more versatile way to increase vitamin D levels.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
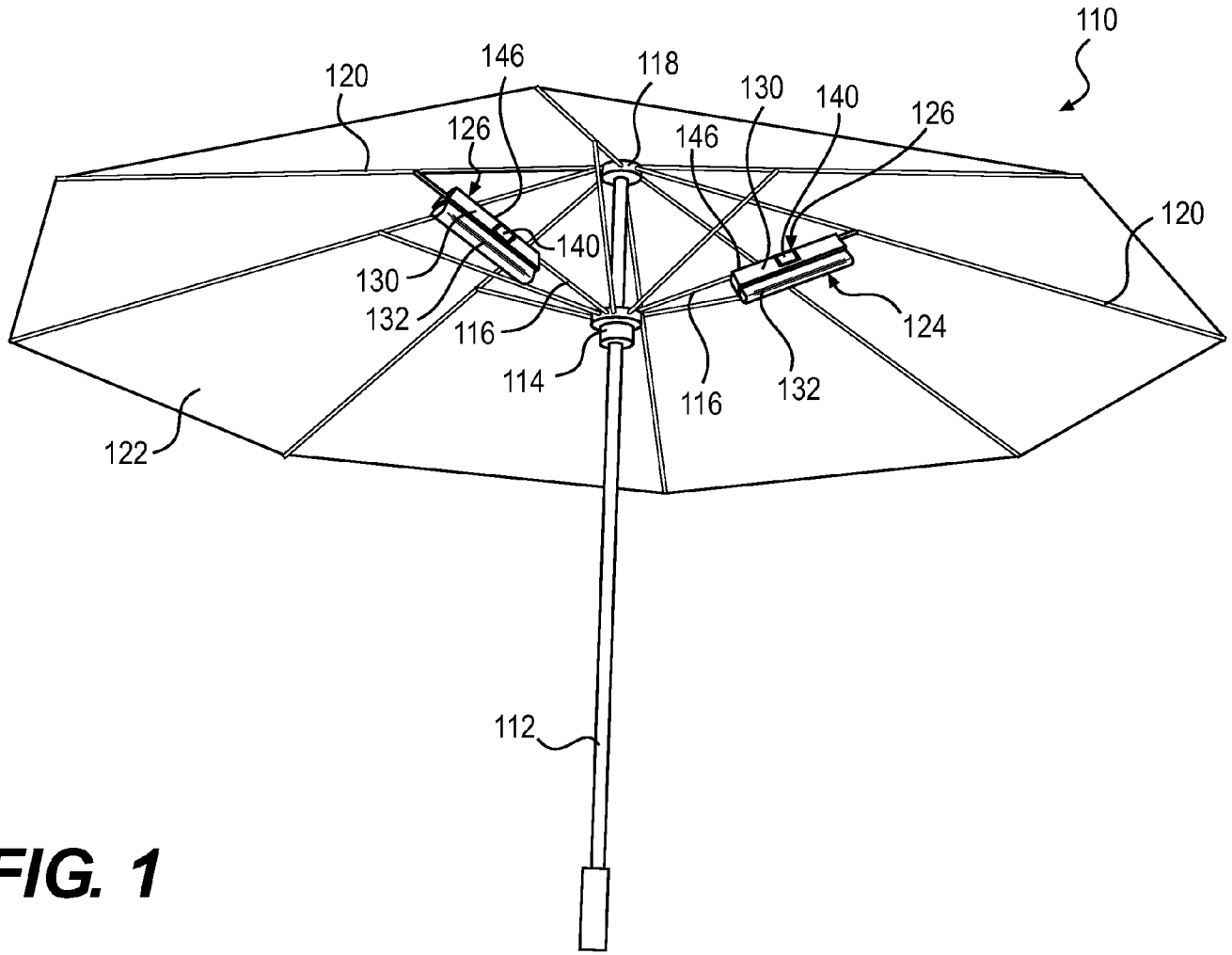
FIG. 1 is a perspective view of the present invention being a compact umbrella with two UV blue light emission devices mounted onto two stretchers.

110 healthy sun-like rays umbrella
112 shaft of umbrella 110
114 runner of umbrella 110
116 stretcher of umbrella 110
118 cap of umbrella 110
120 rib of umbrella 110
122 canopy of umbrella 110
124 UV blue light emission device of umbrella 110
126 mounting structure of umbrella 110
128 person
130 housing of device 124
132 light transmission cover of device 124
134 electric circuit of device 124
136 light emitting diode of electric circuit 134
138 waterproof power source of electric circuit 134
140 switch of electric circuit 134
142 sealed compartment of waterproof power source 138
144 rechargeable battery of waterproof power source 138
146 snap-on clip of mounting structure 126

DETAILED DESCRIPTION OF THE PREFERRED EMBODIMENT

Figure 2:
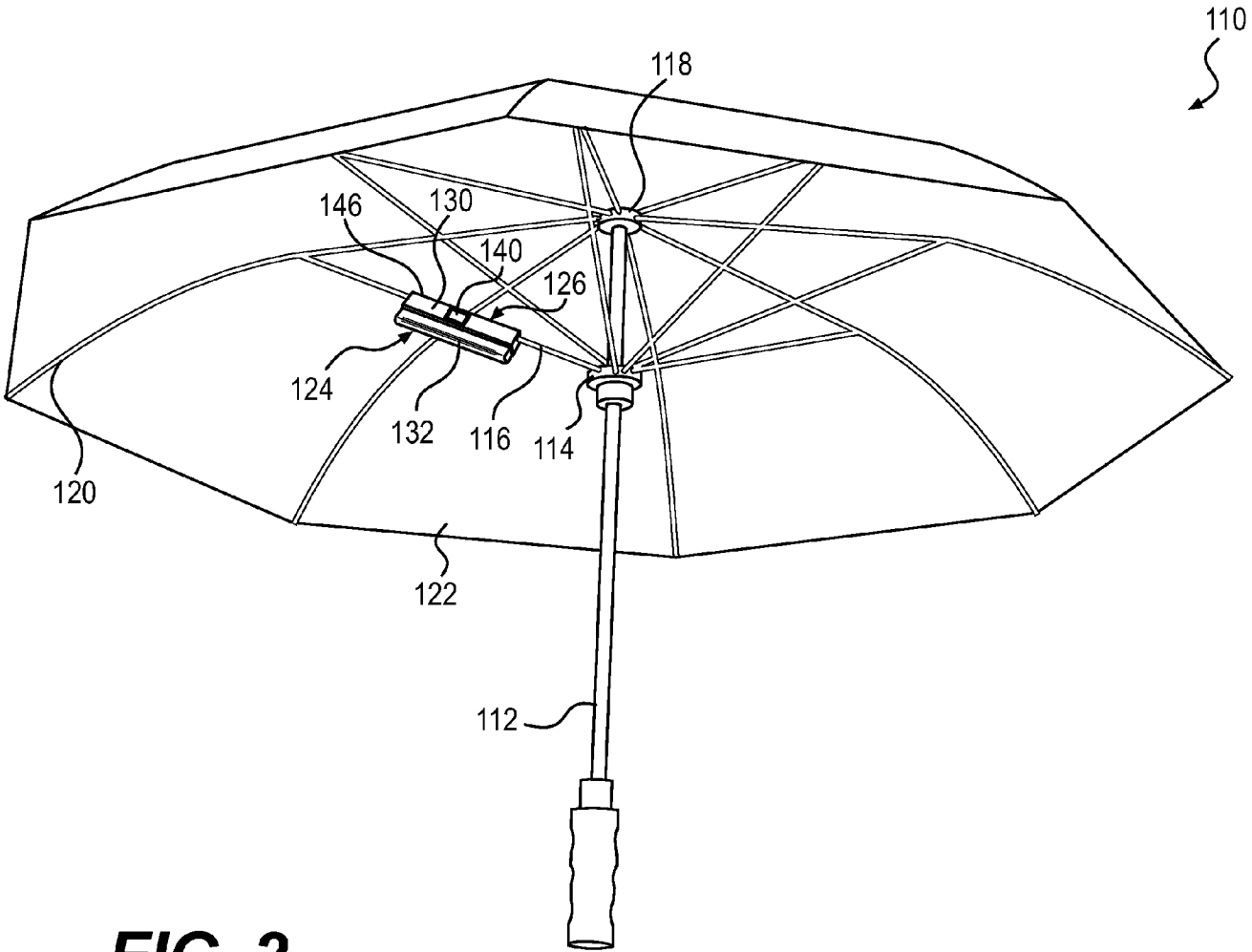
FIG. 2 is a perspective view of the present invention being a golf umbrella with one UV blue light emission device mounted onto one stretcher.
Figure 3:
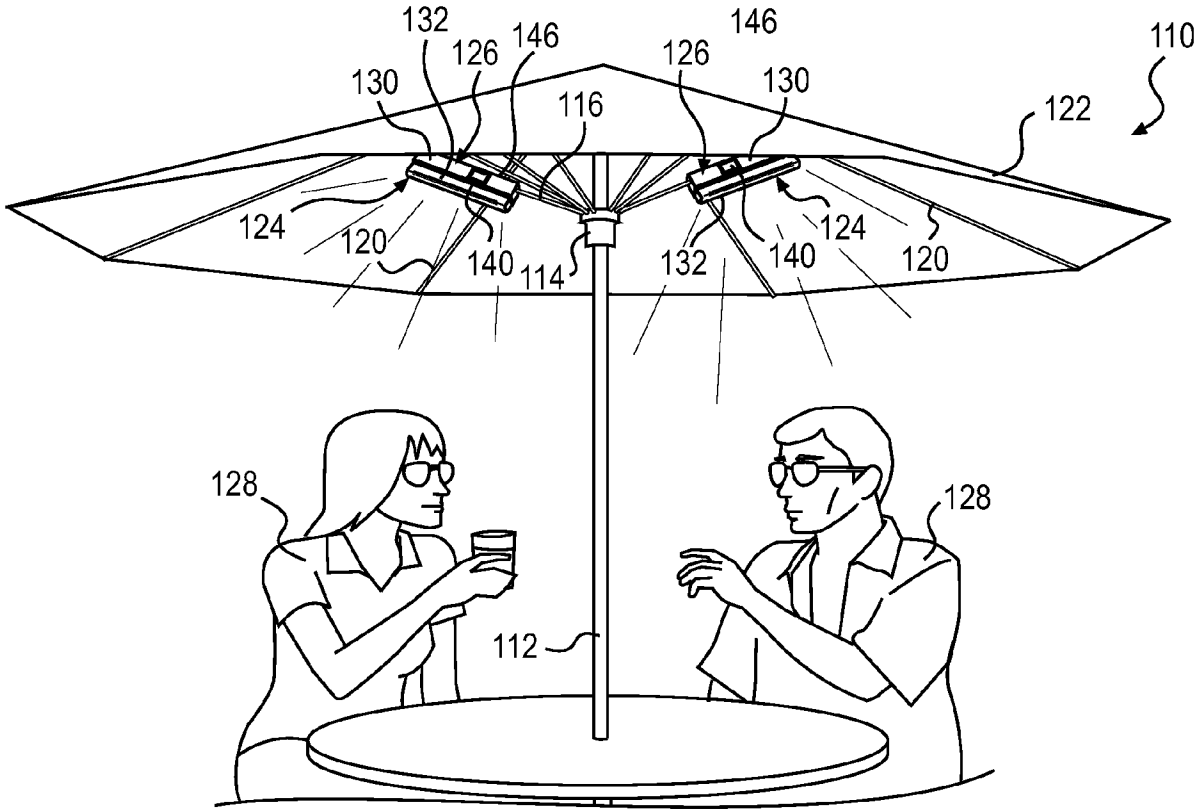
FIG. 3 is a perspective view of the present invention being a patio umbrella with two UV blue light emission devices mounted onto to two stretchers shining on two people sitting at a patio table.

As shown in FIGS. 1, 2 and 3, the present invention is a healthy sun-like rays umbrella 110 which comprises a longitudinally extended shaft 112. A runner 114 is slideably mounted around the shaft 112. A plurality of stretchers 116 are pivotally connected to the runner 114 and are adapted to spread out radially. A cap 118 is affixed onto an upper end of the shaft 112. A plurality of ribs 120 is provided. Each rib 120 has an intermediate portion pivotally connected to an outer end of one of the corresponding stretchers 116 and an inner end pivotally connected to the cap 118. A canopy 122 covers the plurality of ribs 120.

At least one UV blue light emission device 124 is also provided. The UV Blue light in the 405-425 nanometer wavelength range is optimum for triggering vitamin D production and FDA-approved. A structure 126 is for mounting the at least one UV blue light emission device 124 onto at least one stretcher 116. At least one person 128 using the umbrella 110 will receive the benefits of the at least one UV blue light emission device 124 for a seasonal affective disorder and a more versatile way to increase vitamin D levels. When UV Blue Light interacts with your skin, it triggers the formation of vitamin D. Vitamin D is far more than a bone builder. It has widespread influence throughout human being's body, including stimulating the production of feel-good brain chemicals such as serotonin and dopamine. The general recommendation is to expose your face, neck, arms and chest area to the light for 10 to 30 minutes.

Figure 4:
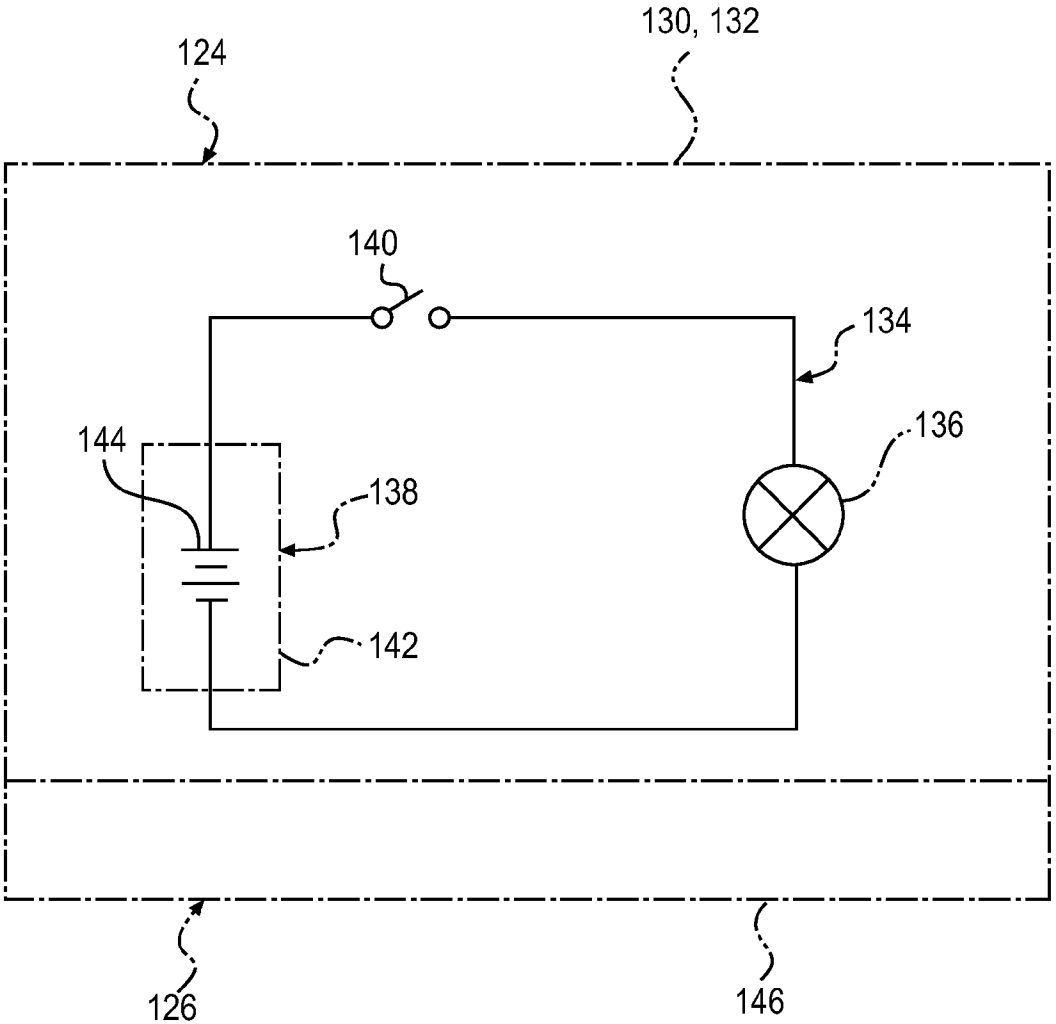
FIG. 4 is a schematic diagram showing the structure and electric circuit of the UV blue light emission device.

As shown in FIG. 4, the at least one UV blue light emission device 124 comprises a housing 130 (e.g. 1 inch (H)×1 ch (W)×7 inches (L)). A light transmission cover 132 is on the housing 130. An electric circuit 134 is in the housing 130 for producing a UV blue light through the light transmission cover 132. The electric circuit 134 comprises a light emitting diode 136. A waterproof power source 138 is electrically connected to the low voltage light emitting diode (LED) 136. The low voltage light emitting diode (LED) 136 can be 1.5 Volts, and 3.0 Volts. A programmable timing switch 140 on the housing 130 is electrically connected between the light emitting diode 136 and the waterproof power source 138. When the programmable timing switch 140 is turned ON, the low voltage light emitting diode 136 will emit the UV blue light in a timing duration: 10 mins, 20 minutes and 30 minutes. The UV blue light LED 136 will be automatically off after the specified timing durations in order to avoid overexposure to the UV blue lights. The overexposure can cause skin disorders.

The waterproof power source 138 comprises a sealed compartment 142 within the housing 130. A rechargeable battery 144 is carried within the sealed compartment 142. The rechargeable battery 144 can be 3-12 Volts. The mounting structure 126 comprises a snap-on clip 146 on the housing 130 to engage with the stretcher 116.

The umbrella 110 as shown in FIG. 1, is a compact umbrella. The umbrella 110 as shown in FIG. 2, is a golf umbrella. The Umbrella 110 as shown in FIG. 3, is a patio umbrella. The umbrella 110 is available in various colors and sizes to accommodate different consumer preferences.

The healthy sun-like rays umbrella 110 provides users with a functional umbrella that has a UV blue light emission device 124 incorporated into the configuration. The present invention may be comprised of different types of umbrellas used for shielding an individual from rain or sun including a compact umbrella, a golfer's umbrella, and a patio umbrella. Multiple UV blue light emission devices 124 can be mounted to the stretchers 116. The devices 124 may also be mounted to the ribs 120, the shaft 112 or other appropriate structural parts of the umbrella 110. Each device 124 has a switch 140 and a waterproof power source 138 such as a sealed compartment 142 for holding a rechargeable battery 144. The umbrella 110 can be available to consumers in various colors and sizes to accommodate various preferences. Materials, mounting methods and other specifications may vary upon manufacturing.

It will be understood that each of the elements described above, or two or more together, may also find a useful application in other types of constructions differing from the types described above.

While the invention has been illustrated and described as embodiments of a healthy sun-like rays umbrella, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A healthy sun-like rays umbrella which comprises:

a) a longitudinally extended shaft;

b) a runner slideably mounted around the shaft;

c) a plurality of stretchers pivotally connected to the runner and adapted to spread out radially;

d) a cap affixed onto an upper end of the shaft;

e) a plurality of ribs, each rib having a intermediate portion pivotally connected to an outer end of one of the corresponding stretchers and an inner end pivotally connected to the cap;

f) a canopy covering the plurality of ribs;

g) at least one UV blue light emission device with 405-425 nanometer wavelength range for simulating sun rays; and h) means for mounting the at least one UV blue light emission device onto at least one stretcher, wherein at least one person using the umbrella will receive the benefits of the at least one UV blue light emission device for a seasonal affective disorder and a more versatile way to increase vitamin D levels.

2. The umbrella as recited in claim 1, wherein the at least one UV blue light emission device comprises:

a) a housing;

b) a light transmission cover on the housing; and c) an electric circuit in the housing for controlling the at least UV blue light emission device in a programmable timing duration.

3. The umbrella as recited in claim 2, wherein the electric circuit further comprises:

a) a low voltage light emitting diode;

b) a waterproof power source electrically connected to the low voltage light emitting diode; and c) a programmable timing switch on the housing electrically connected between the light emitting diode and the waterproof power source, whereby when the programmable timing switch is turned ON, the light emitting diode will emit the UV blue light in a programmable timing duration such as: 10 minutes, 20 minutes and 30 minutes.

4. The umbrella as recited in claim 3, wherein the waterproof power source comprises:

a) a sealed compartment within the housing; and b) a rechargeable battery carried within the sealed compartment.

5. The umbrella as recited in claim 2, wherein the mounting means comprises a snap-on clip on the housing to engage with the stretcher.

6. The umbrella as recited in claim 1, wherein the umbrella is a compact umbrella.

7. The umbrella as recited in claim 1, wherein the umbrella is a golf umbrella.

8. The umbrella as recited in claim 1, wherein the umbrella is a patio umbrella.

9. The umbrella as recited in claim 1, wherein the umbrella is available in various colors and sizes to accommodate different consumer preferences.

10. The umbrella as recited in claim 3, wherein the low voltage light emitting diode is 1.5 volts to 3 volts range.

11. The umbrella as recited in claim 4, wherein the rechargeable battery is 3.0 volts to 12 volts range.

* * * * *